United States Patent [19]

Owen et al.

[11] Patent Number: 5,047,140

[45] Date of Patent: Sep. 10, 1991

[54] PROCESS AND APPARATUS FOR MULTI-STAGE REGENERATION OF CATALYST IN A BUBBLING BED CATALYST REGENERATOR AND SIDE MOUNTED FAST FLUIDIZED BED REGENERATOR

[75] Inventors: Hartley Owen, Belle Mead, N.J.; Paul H. Schipper, Wilmington, Del.

[73] Assignee: Mobil Oil Corporation, Fairfax, Va.

[21] Appl. No.: 515,943

[22] Filed: Apr. 27, 1990

[51] Int. Cl.[5] ..... C10G 11/00; C10G 35/10; B01J 20/34

[52] U.S. Cl. ..... 208/113; 208/120; 208/153; 208/164; 208/158; 208/159; 208/160; 422/144; 422/147; 502/41; 502/43

[58] Field of Search ..... 208/113, 164, 153; 422/144, 147; 502/41, 43

[56] References Cited

U.S. PATENT DOCUMENTS

| | | | |
|---|---|---|---|
| 3,412,014 | 11/1968 | Mattix et al. | 208/164 |
| 4,574,044 | 3/1986 | Krug | 208/113 |
| 4,789,458 | 12/1988 | Haddad et al. | 208/151 |
| 4,820,404 | 4/1989 | Owen | 208/159 |
| 4,851,374 | 7/1989 | Yan et al. | 208/164 |

OTHER PUBLICATIONS

*Oil and Gas Journal*, "Fluid Catalytic Cracking Report" by Amos A., Avidan, Michael Edwards, and Hartley Owen Jan. 8, 1990.

*Primary Examiner*—Helane E. Myers
*Attorney, Agent, or Firm*—Alexander J. McKillop; Charles J. Speciale; Richard D. Stone

[57] ABSTRACT

A process and apparatus are disclosed for achieving turbulent or fast fluidized bed regeneration of spent FCC catalyst in a bubbling bed regenerator having a stripper mounted over the regenerator and a stripped catalyst standpipe within the regenerator. A closed coke combustor vessel is added alongside an existing regenerator vessel, and spent catalyst is discharged into a transfer pot beneath the existing dense bed, then into the coke combustor. Catalyst is regenerated in a turbulent or fast fluidized bed, and discharged into the dilute phase region above the existing bubbling dense bed. The discharge line preferably encompasses, and is in a heat exchange relationship with, the spent catalyst standpipe. Discharge catalyst is collected in the bubbling dense bed surrounding the coke combustor, and may be given an additional stage of regeneration. Catalyst may be recycled from the dense bed to the transfer pot.

7 Claims, 2 Drawing Sheets

PROCESS AND APPARATUS FOR MULTI-STAGE REGENERATION OF CATALYST IN A BUBBLING BED CATALYST REGENERATOR AND SIDE MOUNTED FAST FLUIDIZED BED REGENERATOR

BACKGROUND OF THE INVENTION

1. Field of the Invention

The invention relates to a process and apparatus for the regeneration of fluidized catalytic cracking catalyst.

2. Description of Related Art

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425C-600C, usually 460C-560C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500C-900C, usually 600C-750C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the Oil & Gas Journal.

Modern catalytic cracking units use active zeolite catalyst to crack the heavy hydrocarbon feed to lighter, more valuable products. Instead of dense bed cracking, with a hydrocarbon residence time of 20-60 seconds, much less contact time is needed. The desired conversion of feed can now be achieved in much less time, and more selectively, in a dilute phase, riser reactor.

Although reactor residence time has continued to decrease, the height of the reactors has not. Although the overall size and height of much of the hardware associated with the FCC unit has decreased, the use of all riser reactors has resulted in catalyst and cracked product being discharged from the riser reactor at a fairly high elevation. This elevation makes it easy for a designer to transport spent catalyst from the riser outlet, to a catalyst stripper at a lower elevation, to a regenerator at a still lower elevation.

The need for a somewhat vertical design, to accommodate the great height of the riser reactor, and the need to have a unit which is compact, efficient, and has a small "footprint", has caused considerable evolution in the design of FCC units, which evolution is reported to a limited extent in the Jan. 8, 1990 Oil & Gas Journal article. One modern, compact FCC design is the Kellogg Ultra Orthoflow converter, Model F, which is shown in FIG. 1 of this patent application, and also shown as FIG. 17 of the Jan. 8, 1990 Oil & Gas Journal article discussed above. The compact nature of the design, and the use of a catalyst stripper which is contiguous with and supported by the catalyst regenerator, makes it difficult to expand or modify such units. This means that the large, bubbling dense bed regenerator is relatively difficult to modify, in that it is not easy to increase height much. As the regenerator vessel usually is at or near grade level, it is difficult to do more than minor modifications under the regenerator.

Although such a unit works well in practice, the use of a bubbling bed regenerator is inherently inefficient, and troubled by the presence of large bubbles, poor catalyst circulation, and the presence of stagnant regions. The bubbling bed regenerators usually have much larger catalyst inventories, and longer catalyst residence times, to allow an increase in residence time to make up for a lack of efficiency.

For such units, characterized by a stripper mounted over, and partially supported by, a bubbling dense bed regenerator, there has been no good way to achieve the benefits of high efficiency regeneration, in a fast fluidized bed (FFB) region.

We studied this design, and realized that there was a way to achieve the benefits of multi-stage catalyst regeneration, at least some of which of which is efficient FFB coke combustion, while retaining most of the original design. We were able to significantly increase the coke burning capacity of these units, and provide for much drier regeneration of catalyst in the bubbling dense bed.

BRIEF SUMMARY OF THE INVENTION

Accordingly, the present invention provides a process for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, characterized by: discharging said stripped catalyst from said catalyst standpipe into a closed spent catalyst transfer vessel which is at least partially below said bubbling dense bed; adding a fluidizing gas to said transfer vessel in an amount sufficient to fluidize the spent catalyst and transfer said spent catalyst via a transfer line into a coke combustor pod at an elevation above said transfer vessel and to a side of said regenerator vessel; adding oxygen or an oxygen containing gas to said coke combustor vessel in an amount sufficient to provide a superficial vapor velocity which will maintain a majority of the catalyst therein in a state of turbulent or fast fluidization; transferring catalyst and flue gas from said coke combustor into a transfer line connective with said dilute phase region within said regenerator vessel containing said bubbling fluidized bed; and discharging and separating catalyst and flue gas from said transfer line in a disengaging means which directs separated catalyst from said transfer line down into said bubbling fluidized bed.

In a more limited embodiment, the present invention provides a process for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, characterized by heating said stripped catalyst in said stripped catalyst standpipe by indirect heat exchange with a dilute phase of at least partially regenerated catalyst; discharging said heated stripped catalyst into a closed spent catalyst transfer vessel which is at least partially below said bubbling dense bed; adding combustion air to said transfer vessel in an amount sufficient to burn from 1 to 10% of the coke on the spent catalyst and to fluidize the spent catalyst and transfer it via a transfer line into a coke combustor pod at an elevation above said transfer vessel and to a side of said regenerator vessel; adding additional oxygen or an oxygen containing gas to said coke combustor vessel in an amount sufficient to provide a superficial vapor velocity which will maintain a majority of the catalyst therein in a state of turbulent or fast fluidization; transferring catalyst and flue gas from said coke combustor into a transfer line connective with said dilute phase region within said regenerator vessel containing said bubbling fluidized bed; and discharging and separating catalyst and flue gas from said transfer line into a disengaging means comprising a vertical cylinder which is axially aligned with and at least partially encloses said spent catalyst standpipe, said disengaging means having an inlet connective with the transfer line from the coke combustor and having upper and lower annular outlets within the dilute phase region above the bubbling dense bed.

In an apparatus embodiment, the present invention provides an apparatus for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, said regeneration zone characterized by: a stripper catalyst standpipe having a stripped catalyst upper inlet connective with said catalyst stripper and a lower outlet, a catalyst transfer vessel which is at least partially below said bubbling dense bed having a spent catalyst inlet connective with the lower outlet of said stripper catalyst standpipe outlet, a fluidization gas inlet connective with a source of fluidizing gas, and a catalyst/fluidizing gas outlet; a spent catalyst transfer line having an inlet connective with said transfer vessel and an outlet; a coke combustor pod at an elevation above said bubbling dense bed having an inlet connective with the outlet of said spent catalyst transfer line, an inlet for regeneration air, and an outlet for partially regenerated catalyst and flue gas; a partially regenerated catalyst/flue gas transfer line having an inlet connective with said coke combustor pod outlet and a transfer line outlet connective with said regeneration zone containing said dense bed.

DESCRIPTION OF PREFERRED EMBODIMENTS

Figure 1:
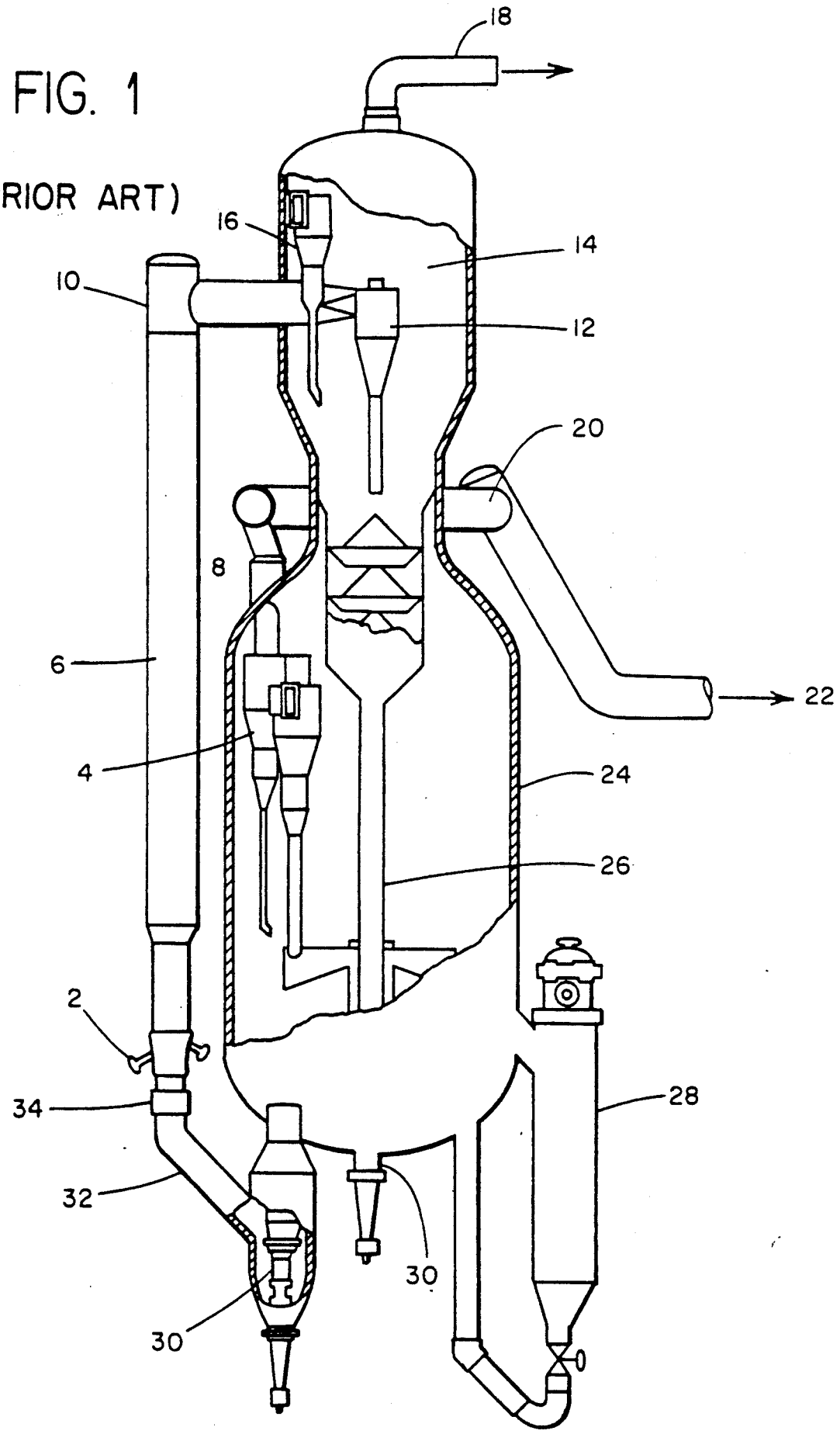
FIG. 1 (PRIOR ART)
FIG. 1 (prior art) is a schematic view of a conventional fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed.

Figure 2:
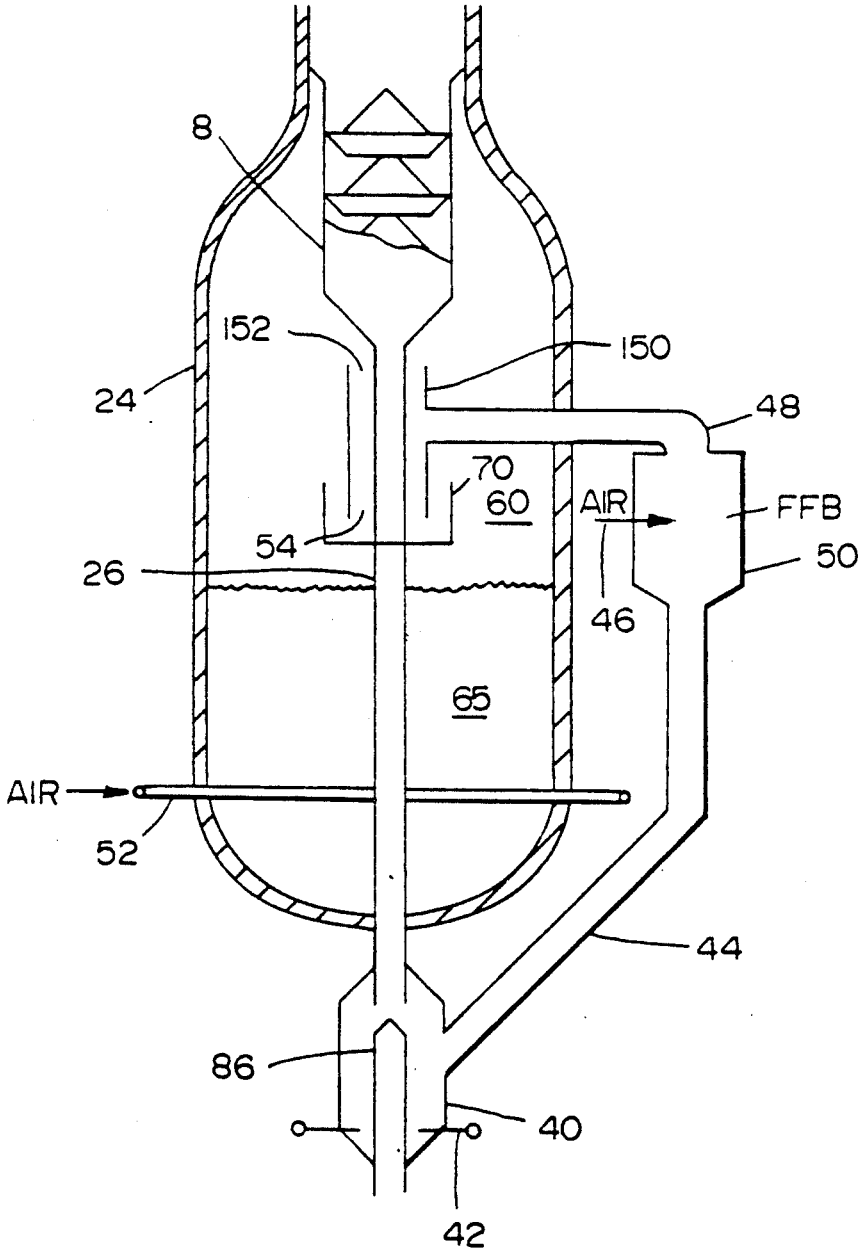
FIG. 2 (invention) is a schematic view of a multistage regenerator of the invention, with a FFB region added to the side of the regenerator.

In FIG. 2 (invention) only the changes made to the old regenerator shell 24 are shown. Like elements in FIG. 1 and 2 have like numerals.

A high efficiency regenerator pod 50 is added to the side of the old regenerator vessel 24. Stripped catalyst from the catalyst stripper 8 is discharged via stripper dipleg 26 down into transport pot 40. The flow of catalyst into the transport pot 40 may be controlled by a plug valve 86, as shown, or the pot 40 may be located a sufficient distance below regenerator 24 to permit installation of a slide valve to control catalyst flow. Spent catalyst dumped into pot 40 is fluidized, and combustion is started, by adding combustion air via line 42. The catalyst is transported via line 44 into side mounted, fast fluidized bed region 50. Preferably additional combustion air is added via line 46. Pod 50 is sized to maintain the catalyst in a highly turbulent state, also called a fast fluidized bed. This requires a superficial vapor velocity of at least about 4 or 5 feet per second, preferably 5–15 feet per second. The catalyst density in a majority of the volume in the coke combustor will be less than 35 pounds/cubic foot, and preferably less than 30 pounds/-cubic foot, and ideally about 25 pounds/cubic foot. Enough air should be added, via line 42 and/or line 46 to burn 20–90% of the coke on the spent catalyst, and preferably 40 to 85% of the coke. Partially regenerated catalyst and flue gas will be discharged via line 48 into regenerator vessel 24. Flow through line 48 will be dilute phase, because of the high vapor velocities involved, usually in the region of 15–50 feet per second.

The partially regenerated catalyst is discharged into the relatively dilute phase atmosphere above the bubbling dense bed of catalyst in regenerator vessel 24, preferably via a disengaging means such as cylindrical disengaging outlet 150. This outlet comprises an inlet connective with horizontal flow line 48, and upper and lower annular outlets 152 and 54. Disengager 150 effects a rough separation of partially regenerated catalyst and flue gas, with a majority of the catalyst being discharged down via annular opening 54 into seal well 70. This seals the bottom of the disengager. Catalyst overflows from well 70 into the bubbling dense bed 65. Flue gas flows primarily out via opening 152. Quite a lot of catalyst will be entrained with the flue gas passing through opening 152, but there will still be much less catalyst traffic in the dilute phase region 60 than would occur if line 48 simple terminated at the side of vessel 24.

Disengager 150 promotes the smooth entrance of partially regenerated catalyst into bubbling dense bed 65, where additional combustion air is preferably added via line 52 to complete catalyst regeneration. It is of course essential to add some fluffing air, to maintain the dense bed 65 in a fluidized state.

It will be frequently be beneficial to recycle some hot regenerated catalyst from bed 65 to transport pot 40, by means not shown. Catalyst can be recycled via a line connective with bed 65, or connected to the dipleg of a cyclone separator in the dilute phase region 60. Use of regenerated catalyst from a cyclone is beneficial because of the higher elevation of the catalyst, and the "head" available to reliably drive regenerated catalyst into pod 40. In many units it will be possible to reduce, and even eliminate, the recycle of regenerated catalyst to pot 40 or to the FFB region 50, because of the significant amount of heat exchange possible between relatively cool spent catalyst in the stripper standpipe 26 and the hotter catalyst in the dilute phase region 60, the high velocity dilute phase region within disengager 50, and the bubbling dense bed 65. Use of conductive refractory linings, or other materials of construction which promote heat transfer into spent catalyst in standpipe 26 will also help.

It may be beneficial to provide catalyst coolers to allow heat removal from around the regenerator, via a catalyst cooler associated with one of the catalyst transfer line, a cyclone dipleg, or the bubbling dense bed. A preferred method of heat removal is to install a heat removal means in the transfer line removing catalyst from the dense bed region and returning it to the reactor. This means that a much cooler catalyst will be used in the reactor, which means that much higher cat:oil ratios can be achieved in the unit, with consequent increases in conversion and gasoline yields.

DESCRIPTION OF PREFERRED EMBODIMENTS

FCC Feed

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is most useful with feeds having an initial boiling point above about 650 F.

The most uplift in value of the feed will occur when a significant portion of the feed has a boiling point above about 1000 F, or is considered non-distillable, and when one or more heat removal means are provided in the regenerator, as shown in FIG. 1 or in FIG. 3.

FCC Catalyst

Any commercially available FCC catalyst may be used. The catalyst can be 100% amorphous, but preferably includes some zeolite in a porous refractory matrix such as silica-alumina, clay, or the like. The zeolite is usually 5–40 wt.% of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1-12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC catalyst vendors.

The FCC catalyst composition, per se, forms no part of the present invention.

Cracking Reactor/Stripper/Regenerator

The FCC reactor, stripper and regenerator shell 24, per se, are conventional, and are available from the M.W. Kellogg Company.

The modifications needed to add the transport Pot 40, whether built partially into, or under, the base of the existing regenerator shell 24, and to add the side mounted coke combustor pod 50 are well within the skill of the art.

Transport Pot Process Condition

The primary function of the transport pot is to move spent catalyst from the regenerator vessel 24 to a coke combustor which is too large to fit under vessel 24. It is also beneficial if some combustion of coke can be accomplished, but this is not strictly necessary. Thus an inert gas could be used to get spent catalyst into the coke combustor pod 50. In order to achieve a measure of coke combustion, and some additional heating of catalyst, it will be beneficial to add enough air, or oxygen containing gas to burn 1 to 10% of the coke, and preferably 2 to 5% of the coke. The superficial vapor velocity in the coke combustor will usually be conventional, to achieve fast fluidized bed coke combustion, usually in excess of 3.5 fps, preferably 4 to 15 fps. In the transfer line 44, the superficial vapor velocity will usually be 10 to 40 fps, and preferably 15 to 30 fps.

Combustor Pod Process Conditions

Conditions in the combustor pod 50, or FFB region, and in the transfer line connecting it to the main regenerator vessel, are similar to those used in conventional High Efficiency Regenerators (HER) now widely used in FCC units. Typical H.E.R. regenerators are shown in U.S. Pat. Nos. 4,595,567 (Hedrick), 4,822,761 (Walters, Busch and Zandona) and U.S. Pat. No. 4,820,404 (Owen), which are incorporated herein by reference.

The conditions in the combustor pod comprise a turbulent or fast fluidized bed region in the base, and approach dilute phase flow in the upper regions thereof. These conditions are conventional. It is highly unconventional to discharge partially regenerated catalyst from the fast fluidized bed into the regenerator and use this to preheat the spent catalyst in the catalyst stripper standpipe within the dense bed regeneration vessel.

FCC Reactor Conditions

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900 to about 1050 F.

CO Combustion Promoter

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

We claim:

1. A process for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, characterized by:

discharging said stripped catalyst from said catalyst standpipe into a closed spent catalyst transfer vessel which is at least partially below said bubbling dense bed;

adding a fluidizing gas to said transfer vessel in an amount sufficient to fluidize the spent catalyst and transfer said spent catalyst via a transfer line into a coke combustor pod at an elevation above said transfer vessel and to a side of said regenerator vessel;

adding oxygen or an oxygen containing gas to said coke combustor vessel in an amount sufficient to provide a superficial vapor velocity which will maintain a majority of the catalyst therein in a state of turbulent or fast fluidization;

transferring catalyst and flue gas from said coke combustor into a transfer line connective with said dilute phase region within said regenerator vessel containing said bubbling fluidized bed; and discharging and separating catalyst and flue gas from said transfer line in a disengaging means which directs separated catalyst from said transfer line down into said bubbling fluidized bed.

2. The process of claim 1 wherein the disengaging means comprises an a vertical cylinder which is axially aligned with and at least partially encloses said spent catalyst standpipe, said disengaging means having an inlet connective with the transfer line from the coke combustor and having upper and lower annular outlets within the dilute phase region above the bubbling dense bed.

3. The process of claim 1 wherein the disengaging means comprises a cyclone separator.

4. The process of claim 1 wherein hot regenerated catalyst is transferred from said bubbling dense bed down to said transport vessel to mix with spent catalyst.

5. The process of claim 4 wherein hot regenerated catalyst is transferred from said bubbling dense bed down to said transport vessel to mix with spent catalyst via a fixed flow catalyst transfer means.

6. The process of claim 5 wherein the fixed flow catalyst transfer means consists essentially of an open pipe connecting the bubbling dense bed to the transport vessel.

7. A process for the fluidized catalytic cracking of a heavy feed to lighter more valuable products by mixing, in the base of a riser reactor, a heavy crackable feed with a source of hot regenerated catalytic cracking catalyst withdrawn from a catalyst regenerator, and cracking said feed in said riser reactor to produce catalytically cracked products and spent catalyst which are discharged from the top of the riser into a catalyst disengaging zone wherein cracked products are separated from spent catalyst, spent catalyst is discharged from said disengaging zone into a catalyst stripper contiguous with and beneath said disengaging zone and wherein said spent catalyst is contacted with a stripping gas to produce stripped catalyst, and said stripped catalyst is collected in a vertical standpipe beneath the stripping zone and then discharged from said standpipe into a catalyst regeneration zone contiguous with and beneath said stripping zone, and said regeneration zone comprises a single dense phase bubbling fluidized bed of catalyst to which an oxygen containing regeneration gas is added and from which hot regenerated catalyst is withdrawn and recycled to said riser reactor, characterized by:

heating said stripped catalyst in said stripped catalyst standpipe by indirect heat exchange with a dilute phase of at least partially regenerated catalyst;

discharging said heated stripped catalyst into a closed spent catalyst transfer vessel which is at least partially below said bubbling dense bed;

adding combustion air to said transfer vessel in an amount sufficient to burn from 1 to 10% of the coke on the spent catalyst and to fluidize the spent catalyst and transfer it via a transfer line into a coke combustor pod at an elevation above said transfer vessel and to a side of said regenerator vessel;

adding additional oxygen or an oxygen containing gas to said coke combustor vessel in an amount sufficient to provide a superficial vapor velocity which will maintain a majority of the catalyst therein in a state of turbulent or fast fluidization;

transferring catalyst and flue gas from said coke combustor into a transfer line connective with said dilute phase region within said regenerator vessel containing said bubbling fluidized bed; and discharging and separating catalyst and flue gas from said transfer line into a disengaging means comprising a vertical cylinder which is axially aligned with and at least partially encloses said spent catalyst standpipe, said disengaging means having an inlet connective with the transfer line from the coke combustor and having upper and lower annular outlets within the dilute phase region above the bubbling dense bed.

* * * * *